US012428179B2

(12) United States Patent
Gualtieri et al.

(10) Patent No.: US 12,428,179 B2
(45) Date of Patent: Sep. 30, 2025

(54) METHOD AND SYSTEM FOR PACKAGING PRODUCTS

(71) Applicant: Fameccanica.Data S.p.A., San Giovanni Teatino Chieti (IT)

(72) Inventors: Diego Gualtieri, San Giovanni Teatino Chieti (IT); Alessandro Cipriani, San Giovanni Teatino Chieti (IT)

(73) Assignee: Fameccanica.Data S.p.A., San Giovanni Teatino Chieti (IT)

( * ) Notice: Subject to any disclaimer, the term of this patent is extended or adjusted under 35 U.S.C. 154(b) by 0 days.

(21) Appl. No.: 18/715,379

(22) PCT Filed: Nov. 11, 2022

(86) PCT No.: PCT/IB2022/060868

§ 371 (c)(1),
(2) Date: May 31, 2024

(87) PCT Pub. No.: WO2023/099994

PCT Pub. Date: Jun. 8, 2023

(65) Prior Publication Data

US 2025/0033811 A1 Jan. 30, 2025

(30) Foreign Application Priority Data

Dec. 3, 2021 (EP) ..... 21212279

(51) Int. Cl.

| | |
|---|---|
| ***B65B 43/10*** | (2006.01) |
| ***B65B 5/02*** | (2006.01) |
| ***B65B 59/00*** | (2006.01) |
| ***D04H 1/49*** | (2012.01) |
| ***D04H 1/492*** | (2012.01) |

(52) U.S. Cl.

CPC ..... *B65B 5/024* (2013.01); *B65B 43/10* (2013.01); *B65B 59/001* (2019.05); *D04H 1/49* (2013.01); *D04H 1/492* (2013.01); *B65B 2210/04* (2013.01)

(58) Field of Classification Search

USPC ..... 53/558

See application file for complete search history.

(56) References Cited

U.S. PATENT DOCUMENTS

| | | | | |
|---|---|---|---|---|
| 3,857,657 | A | 12/1974 | Teed | |
| 4,915,897 | A * | 4/1990 | Farrington | A61F 13/15642 425/81.1 |
| 2010/0190020 | A1* | 7/2010 | Frederiksen | D04H 1/5412 162/146 |
| 2017/0341795 | A1* | 11/2017 | Colson | B65B 57/00 |
| 2018/0215117 | A1 | 8/2018 | De et al. | |

OTHER PUBLICATIONS

International Search Report and Written Opinion dated Feb. 24, 2023. 12 pages.

* cited by examiner

*Primary Examiner* — Chinyere J Rushing-Tucker
(74) *Attorney, Agent, or Firm* — RMCK Law Group PLC

(57) ABSTRACT

A method and system for packaging products, wherein customized boxes are produced using a fibre deposition apparatus based on product information on products or product groups to be packaged.

15 Claims, 4 Drawing Sheets

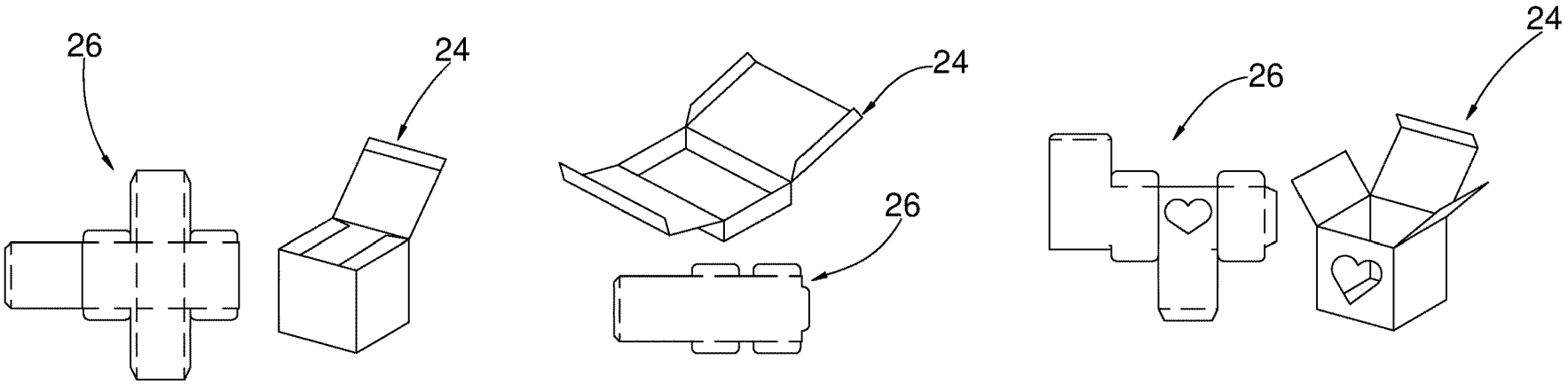
fig.6
fig.7
fig.8
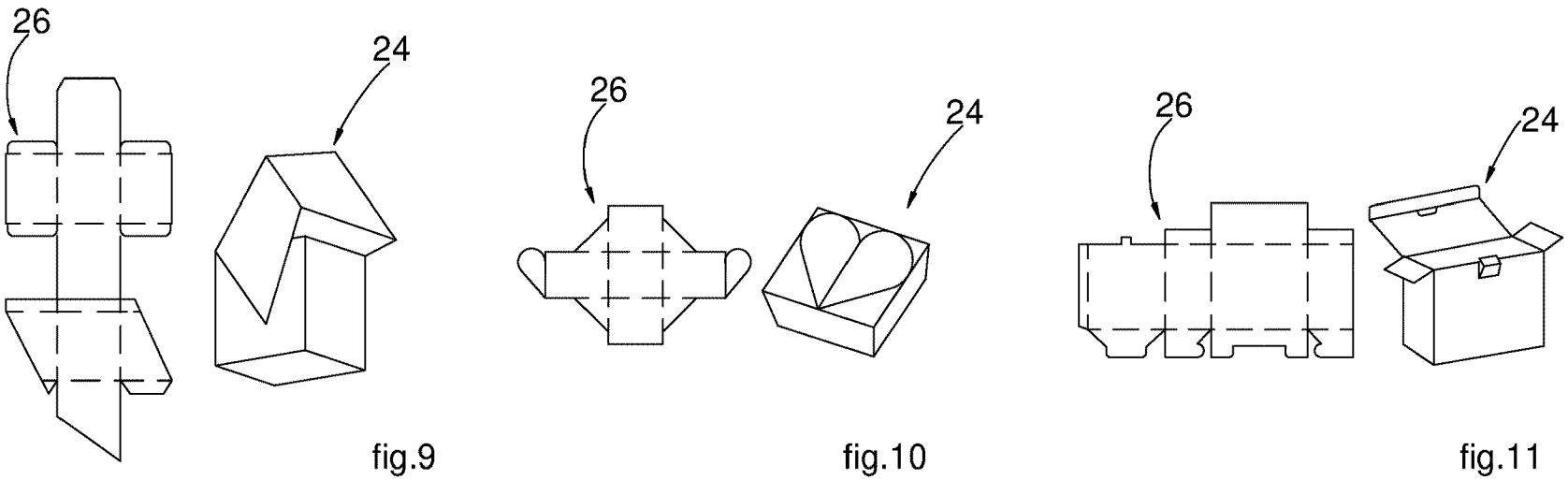
fig.9
fig.10
fig.11

METHOD AND SYSTEM FOR PACKAGING PRODUCTS

CROSS-REFERENCE TO RELATED APPLICATIONS

This application is a 371 National Stage of International Application No. PCT/IB2022/060868, filed Nov. 11, 2022, which claims priority to European Patent Application No. 21212279.0 filed Dec. 3, 2021. The disclosure of each of the above applications is incorporated herein by reference in its entirety.

FIELD OF THE INVENTION

The present invention relates in general to the field of packaging, in particular to packaging of consumer products.

More particularly, the invention relates to a method and system for packaging products to be distributed through e-commerce distribution channels in customized packaging formats.

DESCRIPTION OF THE RELATED ART

With the ever-growing diffusion of e-commerce, customization of packaging is becoming increasingly important.

While the large distribution requires standard packages containing a fixed relatively large number of a single product type, e-commerce distribution systems require small number of products to be packaged in highly customized packages corresponding to the order of the final customer. Typically, an e-commerce order includes different types of products, with a variable number of products for each type of product.

The automated packaging units used for packaging consumer products directed to the large distribution do not have the flexibility required for the e-commerce distribution.

For e-commerce distribution of consumer products, individual products or product groups are frequently packaged in cardboard boxes. Cardboard and paper are the most sustainable materials as they are biodegradable and fully recyclable.

However, packaging of consumer products in cardboard boxes involves considerable problems.

First, blank cardboard boxes are provided to the packaging stations in a relatively low number of standard dimensions. The size of the packaging must necessarily be oversized as compared to the volume of the products to be packaged. This involves a high transport inefficiency since parts of the packages, often considerable parts, are empty.

Packaging products in boxes with standard sizes also involves a great waste of packaging material in that in the vast majority of cases the boxes are greatly oversized for the actual needs.

Transport inefficiency and waste of packaging materials are aggravated by the fact that manufacturers of blank boxes tend to reduce the number of different sizes to reduce costs.

Also, blank boxes are stacked on pallets, which require automatic or manual processes for depalletizing, opening and forming the boxes.

All these aspects have a negative impact on packaging and shipping sustainability and costs.

There is therefore a need for packaging systems and methods which allow packaging of consumer products in customized packages.

OBJECT AND SUMMARY OF THE INVENTION

The object of the present invention is to provide a packaging method and system for the flexible packaging of consumer products which overcome the drawbacks and limitations of the prior art.

Another object of the present invention is to provide packaging method and system having an improved sustainability with respect to prior art solutions, specifically with respect to reduced use of packaging material and improved transport efficiency.

In accordance with the present invention, these objects are achieved by a packaging method having the features of claim 1 and by a packaging system having the features of claim 10.

Optional features of the invention form the subject of the dependent claims.

The claims are an integral part of the teachings submitted in relation to the invention.

BRIEF DESCRIPTION OF THE DRAWINGS

Further characteristics and advantages of the invention will become clear from the following description, given purely as a non-limiting example, with reference to the attached drawings, wherein:

FIGS. 6-11 are schematic views showing examples of various flat box blanks and corresponding boxes which may be manufactured by a system according to the invention.

It will be appreciated that various figures may not be represented on the same scale. It will also be appreciated that in some figures certain elements or components may not be shown for a better understanding.

DETAILED DESCRIPTION

Figure 1:
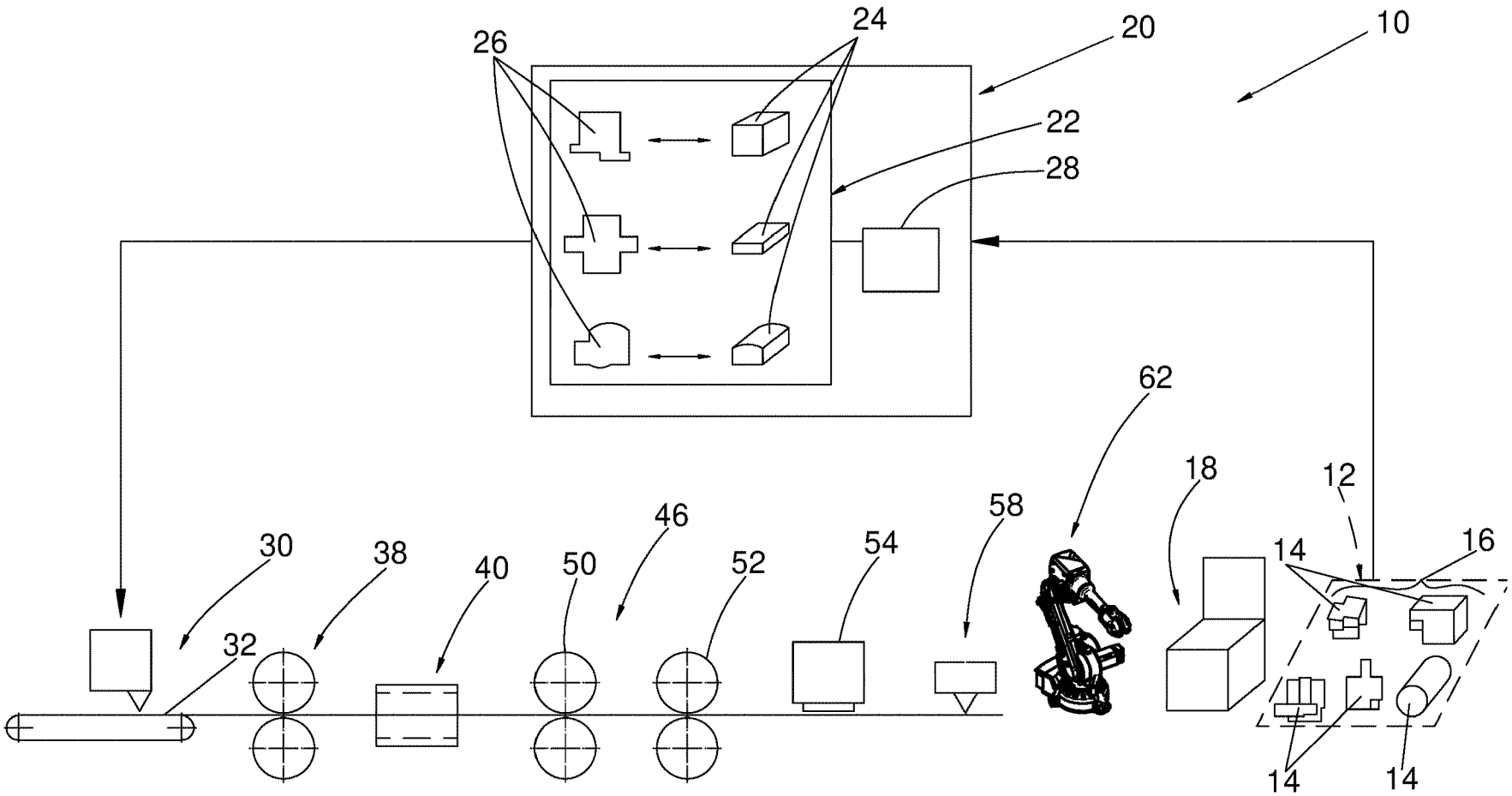
FIG. 1 is a schematic view of a packaging system according to an embodiment of the present invention.

With reference to FIG. 1, a packaging system for packaging consumer products is indicated by the reference numeral 10.

A product 14 or a product group 16 to be packaged in a box 18 are provided in a packaging area 12.

The packaging system 10 comprises an electronic control unit 20 which receives product information on the product 14 or product group 16 to be packaged.

The product information provided to the electronic control unit 20 may include dimensions and/or weight of the products 14 or product groups 16 and any other information relevant for the composition of the shipping package.

The electronic control unit 20 may receive product information from an e-commerce server which receives orders from an e-commerce network. Each order may include different types of products and a variable number of products for each type of product.

The electronic control unit 20 may also receive product information from code readers, from automatic store units which provide the products 14 or product groups 16 based on shipping orders, or from any other source of product information.

The electronic control unit 20 may also receive shipping information such as name and address of the recipient of the package, as well as information on aesthetic features of the package, e.g. messages to be printed on the package, decorative elements, etc. that may be selected by the customer when placing the order.

The electronic control unit 20 is associated to a data storage memory 22 in which data of a plurality of box designs 22 are stored. The data of the plurality of box designs may include data on flat blank designs 24 corresponding to the respective box designs 22.

The data storage memory 22 may contain data of hundreds or thousands of different box designs 22 suitable for a multitude of different products 14 and product groups 16. FIGS. 6-11 show a few examples of possible box designs 24 and respective flat box blanks designs 26.

The electronic control unit 20 may comprise a processing unit 28 having installed therein software configured for selecting among the plurality of box designs 24 stored in the data storage memory 22 a box design suitable for the product 14 or product group 16 to be packaged. The processing unit 28 carries out the selection of the box design 24 based on the product information received. In particular, the processing unit 28 selects the box design 24 with the smallest possible dimensions necessary for containing the product 14 or product group 16. The selection of the box design 24 aims at minimizing the empty volume of the packaging and the quantity of packaging material. In selecting the box design 24 the processing unit 28 may consider customer preferences possibly contained in the order.

The packaging system 10 comprises a fibre deposition apparatus 30 configured for depositing loose unbound fibres, e.g. cellulose fibres, on a moving support 32.

The fibre deposition apparatus 30 may be configured for projecting loose unbound cellulose fibres by pressurized air jets. The loose unbound cellulose fibres may be projected onto a porous surface e.g. a flat needlefelt, fluidly connected to a suction source.

The fibre deposition apparatus 30 may a 3D-Lofter manufactured by the company Dilogroup. A 3D-Lofter is an aerodynamic web-forming machine, which distributes fibres 3-dimensionally on a moving surface in accordance with a programmable deposition pattern, resulting in a loose fibres pattern with a desired shape, which may also have locally varying thickness, strength and stiffness. The 3D-Lofter uses high pressure air flows to convey the fibres and deposit them with precision on a movable porous support connected to a suction source.

The electronic control unit 20 sends to the fibre deposition apparatus 30 instructions for depositing loose unbound fibres on the moving support 32 in a pattern corresponding to the flat blank design 26 of the box design 24 selected by the processing unit 28 based on the product or product group information.

Figure 2:
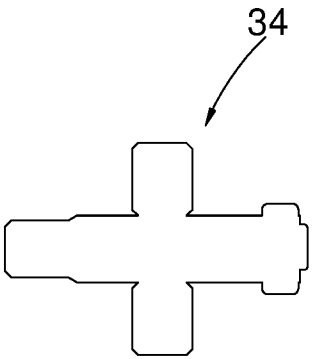

FIG. 2 shows a pattern of loose unbound fibres 34 exiting the fibre deposition apparatus 30. The fibre deposition apparatus 30 may produce a succession of patterns of loose unbound fibres 34 each one different from the others, customized to each specific shipping order.

Sensors e.g. humidity, temperature, brightness sensors may be embedded in the loose unbound fibres. Additional layers e.g. of thermoplastic fibres, may be added for forming water resistant coatings.

Figure 3:
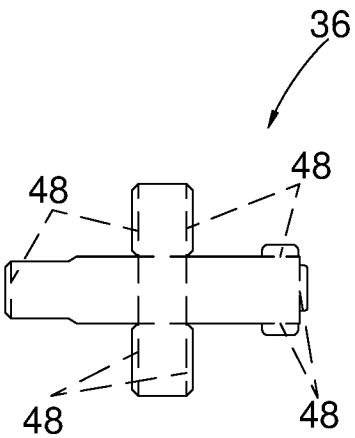

The pattern of loose unbound fibres 34 exiting the fibre deposition apparatus 30 is then consolidated to form a flat box blank 36 (FIG. 3).

With reference to FIG. 1, in a possible embodiment consolidation of the loose unbound fibres 34 into a stable flat box blank 36 may be carried out by pressing the loose unbound fibres 34 between a pair of pressing rollers 38 followed by cooking in an oven 40.

Figure 12:
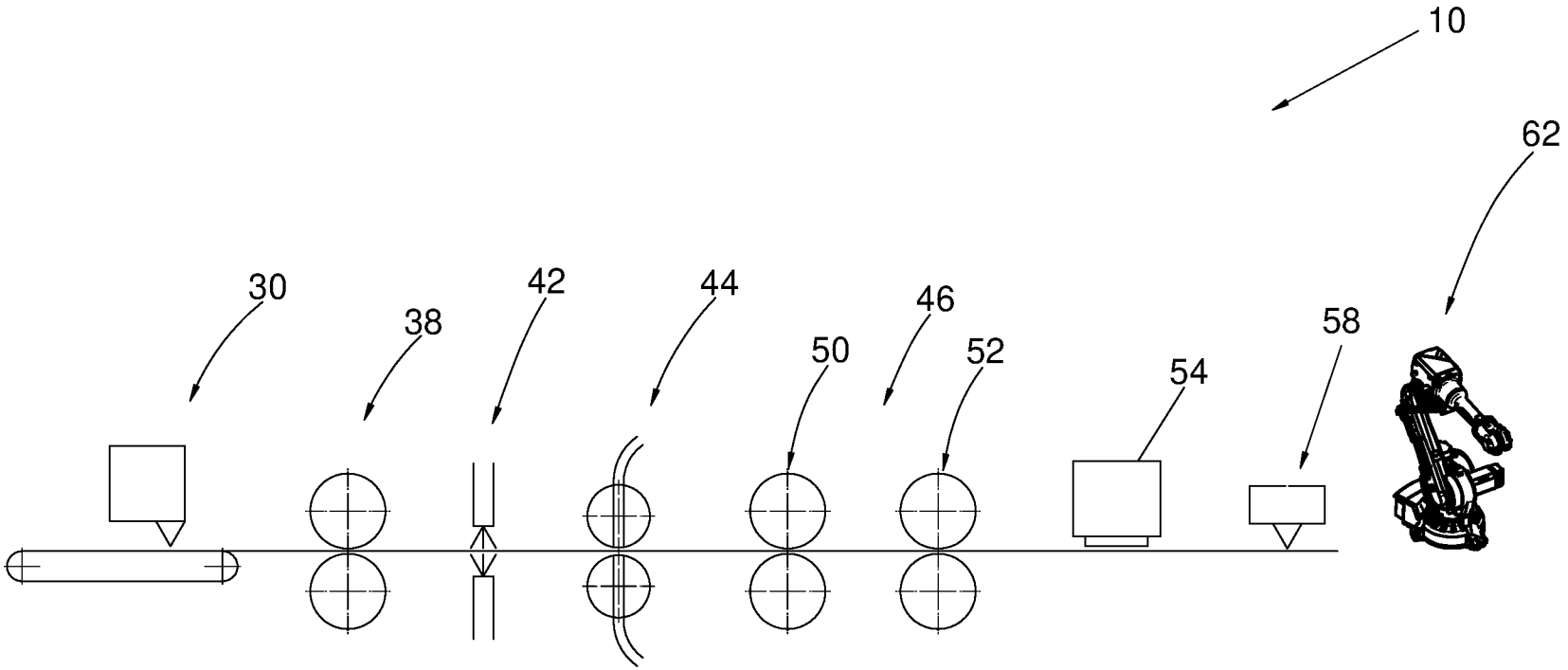
FIG. 12 is a schematic view of another embodiment of a packaging system according to the present invention.

With reference to FIG. 12, in a possible embodiment consolidation of the loose unbound fibres 34 into a stable flat box blank 36 may be carried out by pressing the loose unbound fibres 34 between a pair of pressing rollers 38 followed by hydroentanglement of the loose fibres in a hydroentanglement unit 42 and water removal in water removal pressure rollers 44.

With reference to FIGS. 1, 12 and 3, after consolidation of the loose unbound fibres 34 into a stable flat box blank 36, the flat box blank 36 may be subjected to embossing in an embossing unit 46 for forming folding lines 48 on the flat box blank 36. The embossing unit 46 may comprise machine direction embossing rollers 50 and cross-direction embossing rollers 52.

Figure 4:
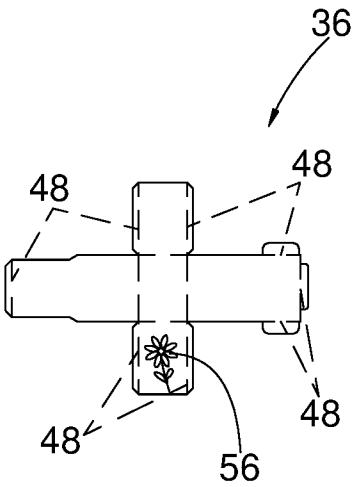

With reference to FIGS. 1, 12 and 4, the flat box blank 36 may pass through a printer 54 configured for printing on selected areas of the flat box blank 36 prints 56 of different types, e.g. barcodes containing shipping information, logos of the manufacturing or shipping company, customized messages selected by the customer, decorative images, etc.

Figure 5:
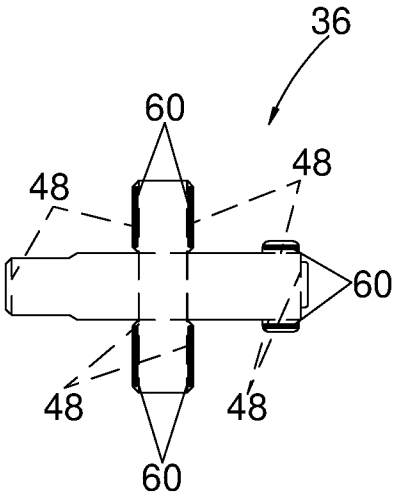
FIGS. 2, 3, 4 and 5 are schematic views showing the formation of a flat box blank.

With reference to FIGS. 1, 12 and 5, the flat box blank 36 may pass through a glue dispenser 58 configured for applying glue patterns 60 on selected areas of the flat box blank 36.

With reference to FIGS. 1 and 12, the packaging system 10 may comprise a robot 62 configured for automatically assembling the flat box blanks 36 into final boxes 18. The robot 62 may operate under instructions provided by the electronic control unit 20. Alternatively, assembling the flat box blanks 36 into final boxes 18 may be carried out manually.

The product 14 or product group 16 is then placed into the customized box 18 and the box 18 is closed. Placing the product 14 or product group 16 into the customized box 18 may be carried out by the same robot 62 which assembles the boxes 18. Instructions for placing the product 14 or product group 16 into the customized box 18 may be provided by the electronic control unit 20. Alternatively, placing the product 14 or product group 16 into the customized box 18 may be carried out by a dedicated robot or manually.

The main advantages of the solution according to the present invention are the following:

- extreme flexibility in the formation of the packaging boxes;
- volume and shape of the boxes are adapted to the content to minimise waste of packaging material and to optimize transport efficiency;
- possibility to print on the boxes shipping information, which avoids the application of bar code labels on the boxes;
- shape and decorative elements of the boxes can be requested by the customer;
- possibility to add sensors (e.g. humidity, temperature, brightness sensors) or thermoplastic coatings on request.

The solution according to the present invention provides a substantial contribution to sustainability of e-commerce packaging in that it reduces waste of packaging material and improves transport efficiency.

Also, the solution according to the present invention reduces significantly the use of manpower for the e-commerce packaging.

Of course, without prejudice to the principle of the invention, the details of construction and the embodiments can be varied, even significantly, with respect to those illustrated here without departing from the scope of the invention as defined by the following claims.

The invention claimed is:

1. A method for packaging products, comprising:

storing in a memory storage unit data of a plurality of box designs, providing product information on a product or product group to be packaged, selecting a box design among said plurality of box designs based on said product information, providing a fibre deposition apparatus configured for depositing loose unbound fibres on a moving support, sending instructions to said fibre deposition apparatus for depositing a pattern of loose unbound fibres corresponding to a flat blank of the selected box design, consolidating said pattern of loose unbound fibres to form a flat box blank of the selected box design, folding the flat box blank to form a customized box with the selected box design, and packaging said product or a product group in said customized box.

2. The method of claim 1, wherein the loose unbound fibres are deposited by projecting the loose unbound fibres by pressurized air jets onto a surface of said moving support fluidly connected to a suction source.

3. The method of claim 1, wherein said product information includes a dimension and/or a weight of said product or product group.

4. The method of claim 1, comprising providing said product information to an electronic control unit including a processing unit having installed therein software configured for selecting among said plurality of box designs stored in said data storage memory a box design suitable for the product or product group to be packaged.

5. The method of claim 4, comprising folding said flat box blank to form said customized box by an automatic robot controlled by said electronic control unit.

6. The method of claim 1, comprising printing shipping information and/or customized prints on said flat box blank.

7. The method of claim 1 comprising consolidating said loose unbound fibres into a stable flat box blank by pressing the loose unbound fibres between a pair of pressing rollers followed by cooking in an oven.

8. The method of claim 1, comprising consolidating said loose unbound fibres into a stable flat box blank by pressing the loose unbound fibres between a pair of pressing rollers followed by hydroentanglement of the loose fibres in a hydroentanglement unit and water removal in water removal pressure rollers.

9. The method of claim 1, comprising integrating sensors in said loose unbound fibres.

10. A packaging system, comprising:

a memory storage unit having stored therein data of a plurality of box designs, a fibre deposition apparatus configured for depositing loose unbound fibres on a moving support, a processing unit configured for receiving product information on a product or product group to be packaged, for selecting a box design among said plurality of box designs based on said product information, and for sending instructions to said fibre deposition apparatus for depositing a pattern of loose unbound fibres corresponding to a flat blank of the selected box design, and a consolidating unit configured for consolidating said pattern of loose unbound fibres to form a flat box blank of the selected box design.

11. The packaging system of claim 10, comprising a robot configured for folding said flat box blank based on instructions provided by said processing unit.

12. The packaging system of claim 10, comprising a printer configured for printing shipping information and/or customized prints on said flat box blank.

13. The packaging system of claim 10, wherein said consolidating unit comprises a pair of pressing rollers followed by a cooking oven.

14. The packaging system of claim 10, wherein said consolidating unit comprises a pair of pressing rollers followed by an hydroentanglement unit and by water removal pressure rollers.

15. A non-transitory computer-readable storage medium having a computer program stored thereon containing instructions which, when executed by one or more processors, causes the one or more processors to implement the method according to claim 1.

* * * * *